United States Patent [19]

Everett

[11] Patent Number: 4,975,983

[45] Date of Patent: Dec. 11, 1990

[54] SHIRT COLLAR STAY SYSTEM

[76] Inventor: Robert A. Everett, 704 S. 142 East Ave., Tulsa, Okla. 74108

[21] Appl. No.: 361,641

[22] Filed: Jun. 5, 1989

[51] Int. Cl.[5] ..... A41D 27/16

[52] U.S. Cl. ..... 2/60

[58] Field of Search ..... 2/60, 255, 256, 257, 2/258, 259, 260, 260.1, 261, 262, 263, 264; 24/41, 42, 43, 44, 45, 46, 47, 48

[56] References Cited

U.S. PATENT DOCUMENTS

| | | | |
|---|---|---|---|
| 793,890 | 7/1905 | Maxon | 2/60 |
| 797,971 | 8/1905 | Montgomery | 2/60 |
| 808,816 | 1/1906 | Connell | 2/60 |
| 879,955 | 2/1908 | Frank | 2/60 |
| 955,631 | 4/1910 | Cerri | 2/60 |
| 1,000,033 | 8/1911 | Murphy | 2/60 |
| 1,013,126 | 1/1912 | Cerri | 2/60 |
| 1,546,588 | 7/1925 | Kilgore | 2/60 |
| 1,768,384 | 6/1930 | Villasenor | 2/60 |
| 2,819,469 | 1/1958 | Lyles | 2/60 |
| 2,888,723 | 6/1959 | Baruch | 24/41 |
| 4,286,337 | 9/1981 | Malouf | 2/256 |

FOREIGN PATENT DOCUMENTS

| | | | |
|---|---|---|---|
| 31375 | 1/1908 | Fed. Rep. of Germany | 2/60 |
| 255572 | 1/1949 | Switzerland | 2/60 |
| 15450 | of 1888 | United Kingdom | 2/60 |

*Primary Examiner*—Werner H. Schroeder
*Assistant Examiner*—Diana L. Biefeld

[57] ABSTRACT

An improved shirt collar stay system that has a slot-like channel that surrounds and grips the vertical and horizontal edges of a shirt collar as a stay and as a fringe. The channel design has an upper vertical section and a lower section connected by linkage that can fold via pivot means to engage both vertical and lower edges of said collar. The said channels's length has a leg member with a curve containing protrusions on the contact portion of its surface of the leg member and also contains spring-like means. Both features are for gripping, when engaged with material or said collar's edges. The top portion of the upper vertical section of the channel has flexibility that engages and grips the top vertical portion of the collar and will follow a curved contour of such a collar design. The upper vertical section of the channel has on its outside surface an arm extension member with holes along its length as decorations and end holes become part of a locking means, when the lower section of the said channel is engaged with the horizontal collar's edge and locked onto studs that are part of the lower section of said channel's outside surface, so that when the end holes match up with a suitable lock-stud they can be snapped together as a positive engagement, and thus a shirt collar of a new appearance is presented.

10 Claims, 1 Drawing Sheet

SHIRT COLLAR STAY SYSTEM

BACKGROUND OF THE INVENTION

1. Field of the invention:

This invention relates to wearing apparel and holding their shape, stiffness and adding decorative enhancement type fringe along the edges of suitable apparel and more particularly, that of shirt collars.

2. Prior art:

In the past there have existed many different types of features for holding the shape and keeping down the collars of shirts. Some of these include buttons that are sewn to the shirt and button holes to hold the collar. Also many different collar are stays provided for the inside and outside of the shirt collars made of plastic and metal to provide stiffness to the shirt collars. These different designs, while functional do have disadvantages. The button type only holds the collar down and does nothing in keeping the collar stiff and neat and is subject to coming off the shirt when washed. As the collar stays, both inside and outside types are frequently ending up out of shape, broken or lost. Outside type collar stays besides being lost are time consuming in getting them placed correctly on the underside of the collar. The metal stay with springs for tension gives the collar an unnatural overly stuffed, bulky look to the shirt collar and are expensive to replace if lost or bent; which when bent will cause the small springs to jam.

SUMMARY OF THE INVENTION

The principal object of the present shirt collar stay, is to provide an improved collar stay on the outside vertical edge of a shirt collar, as well as the outside horizontal bottom edge of the shirt collar and also to function as an adornment type article.

It is a general object of the present invention to provide a simple shirt collar stay which is easy to put on and remove.

Another object is to provide an improved outside mounting stay that also has flexible means to cover the complete verticle edge of the shirt collar so it can fit over the curved contour of a roll or curved type shirt collar.

Still another object is that the length of the slot-like channel has a back-leg portion having an outward curved shape that allows for a shirt collar to engage the stay with ease and also giving this curved portion a spring tension means.

Yet another object is that this back-leg portion of the slot-like channel has on its surface, that contacts the shirt collar, has matrusion means for a gripping and holding function.

An additional object is that arm extensions of the improved stay provides decorative design means including perforated holes, which also function as a locking means with the lower horizontal stay section when pivoted into engagement with the bottom horizontal edge of the shirt collar.

BRIEF DESCRIPTION OF THE DRAWINGS

The above mentioned, and the features and the objects of the present invention will become more apparent by reference to the following description taken in conjunction with the accompanying drawings, wherein like-referenced numerals to like-elements, and in which.

DESCRIPTION OF PREFERRED EMBODIMENT

Referring now more particularly to the drawings, like numerals in the various figures will be employed to designate like parts. The stay of the present invention are produced in pairs, but the drawings show only the left stay 10 and the right stay is the same, except produced in a reverse like manner.

Figure 1:
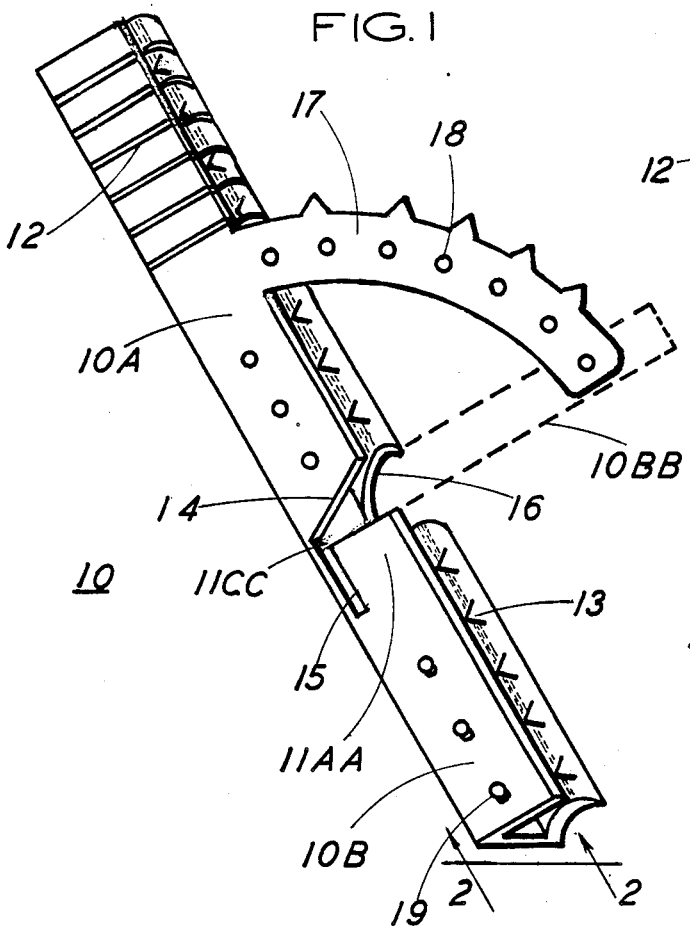
FIG. 1 is an enlarged perspective view of a one part stay of the present invention, and showing a lower section, in a phantom folded position.
Figure 4:
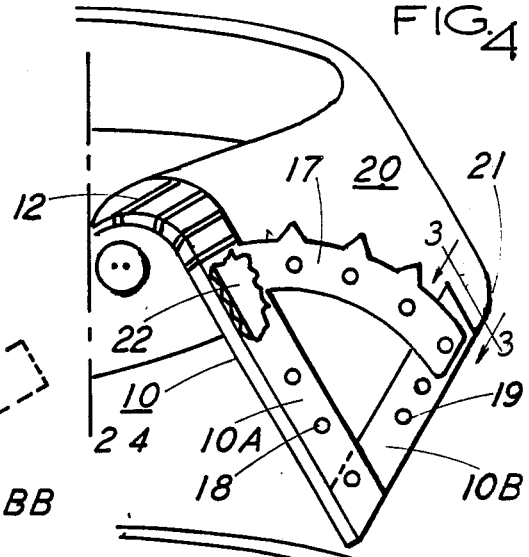
FIG. 4 is a partial view of a collar showing one stay locked in place.
Figure 2:
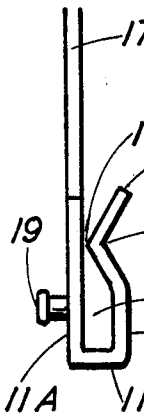
FIG. 2 is an end view in the direction of arrows 2—2 of FIG. 1 showing detailed parts of a stay and of the slot-like channel.
Figure 3:
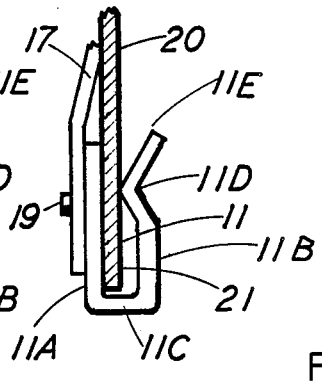
FIG. 3 is an end view in the direction of arrows 3—3 of FIG. 4 showing the detail parts of the stay engaged with a collar and an arm extension locked in place.

The stay 10 of preferred embodiment has embodied through its complete length, features that make up a slot-like channel 11, which is the portion of the stay 10 that engages and grips a shirt collar 20 along lower horizontal edge 21 and front vertical edge 22 shown in FIG. 4 to form a fringe on the outside of same. The stay 10 has features that combine to form the channel 11, and in FIGS. 1, 2 and 3 shows an outside fringe portion that includes a front-leg **11*a* and a back-leg 11*b* and a bottom-leg 11*c* that form the stay 10. The channel 11 is formed in substantialy two sections; an upper vertical section 10A and a lower section 10B which are separated by two cut-outs space about midway along the channel 11. One is cut-out 14 located on the front-leg 11*a* and the second one located just opposite on the back-leg 11*b* is cut-out 16 shown in FIG. 1. This cutout feature leaves only the bottom-leg 11*c* portion connecting the two sections 10A and 10B A link-strip 11*cc* functions as a pivot and thus allows the lower section 10B to pivot to a suitable angle 10*bb* when engaging the stay 10 onto the vertical collar's edge 22 in FIG. 1 and in FIG. 4**.

In the front-leg **11*a* of section 10B at the front cut-out 14 is a short-slot 15 running parallel along the bottom of the front-leg 11*a* for a short distance, shown in FIG. 1 when the lower section 10B is pivoted at a suitable angle, a small tab 11*aa* formed by the short-slot 15 will move up inside or outside of the front-leg 11*a* of the upper vertical section 10A and cover over any collar 20** material that might show in this area.

Along the length of the stay 10 and on the curved surface of the back-leg **11*b* is a gripping functionality created by the spring-like tension characteristic design of the back-leg 11*b* as shown in FIGS. 2 and 3. Also along the length of the curved surface of the back-leg 11*b* is a stop means shown in FIG. 1 and FIG. 2 as pointed protrusions 13 that increases the gripping power when combined with the spring-like tension of the back-leg 11*b*. Two other features of the back-leg 11*b* are a bend or indent 11*d* that is a point application of of pressure of this surface and a flare-opening 11*e* of the channel 11 for ease of insertion of suitable material into the channel 11 shown in FIG. 2 and FIG. 3**.

The top end portion of section 10A includes a flexible means, 12 that is like that of a multple ribs or accordion-like section, yet it has the same general shape and grip means of the said channel 11 and all its features. This flexible means 12 functions to engage and follow the contour curve of a roll type collar while gripping and holding the collar's 20 shape with added stiffness and adding of a trim-like fringe border shown in FIG. 4 and FIG. 5.

Figure 5:
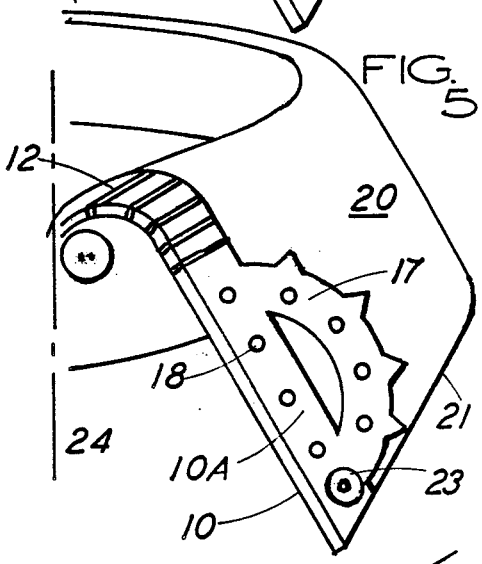
FIG. 5 is a partial perspective view of a shortened version of the present invention, that engages only the vertical portion of a shirt collar.

FIG. 4 and FIG. 5 show an arm extension 17 as part of the upper vertical section 10A and front-leg 11*a* and takes on different design configurations to enhance the looks of a shirt 24 and collar 20. These arm extensions 17 have located along their length multiple holes 18, with like holes in the front-leg 11*a* for decoration as well as for use in accepting a stick-pin 23 if desired. The holes 18 at the tip arm extensions 17 are able to receive lock-studs 19, located along the outside surface of the lower section 10B and recieve these lock-studs 19 when the lower section 10B has been pivoted and engaged with the shirt collar 20, thus forming what appears as one unit that adds neatness, color and decorations to enhance the look of any shirt 24.

To engage the shirt collar 20 with the stay 10; the link-strip 11*cc* is lined up with the collar's 20 and the upper vertical section 10A receives the collar's edge 22 with some resistance from the slot-like channel 11 and its spring-like tension back-leg 11*b*. Then the lower section 10B is pivoted up to engage the collar's lower horizontal edge 21 into channel 11 which completes the engagement and then the arm extension 17 is snapped onto one of the locking-studs 19 with a suitable hole 18 and any extra length of the flex-means 12 or arm extension 17 can be trimoff to suit, thus giving a collar; color, neatness and decorative enhancement and means for accepting a jeweled pin 23.

FIG. 5 illustrates an alternate embodiment of the stay 10 that includes only the upper vertical section 10A and eliminating the complete lower section 10B along with the central cut-outs 14 and 16. The section 10A includes channel 11 and its components including the flexible means 12 and the short arm extension 17 with perforated holes 18. These same holes appearing in the front-leg 11*a* and the back-leg 11*b* line up for accepting a jeweled type stick pin 23 or the like through the legs 11*a* and 11*b* and the shirt collar's edge 22 as well as the shirt 24 if desired.

Figure 6:
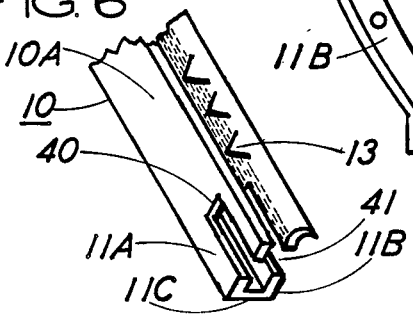
FIG. 6 is a modified vertical end view portion of a short stay version.

In FIG. 6 shows an alternate embodiment of the upper vertical section, 10A including vertical cut-outs 40 and 41, in the form of a type knock-out design or have vertical cut-out 40 in the front-leg 11*a* and an identical cut-out 41 in the opposite back-leg 11*b*. This alternate embodiment of stay 10 can be used with a button down style collar.

Figure 7:
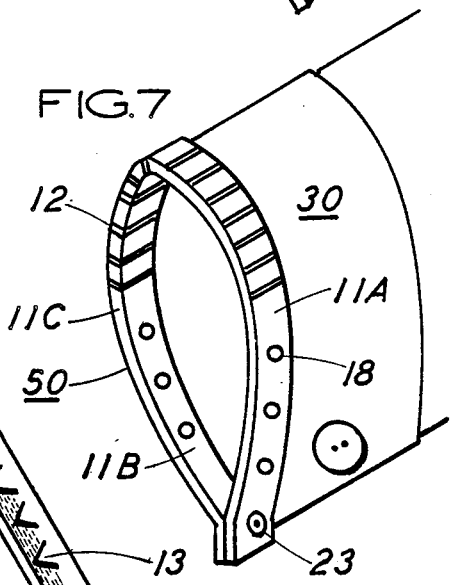
FIG. 7 is a view of an extreme modification of the invention on a sleeve.

FIG. 7 shows an alternate embodiment of a stay 50 that retains the same channel 11 with all the components above described and eliminates the cut-outs 14 and slot 15. Flexible means has a central location and the 10A and 10B and of the required length, It may be necessary for the complete stay 50 to include flexible means 12 along the entire length of the stay 50. The said channel 11 has its components and gripping features and decorative holes 18 in the front and back-legs 11*a* and 11*b* respectively with the bottom-leg 11*c* retaining its function as a connector between them, but the holes 18 can be used for adornment such as with a stick-pin 23 or as a locking means. It is possible of course to have some versions of the arm extensions 17 in this type of modification, but they are not shown. This stay 50 shown in FIG. 7 could be applied to other suitable garments in promoting of neatness, trim, color and decorative enhancement of garments or material.

This disclosure has been given by way of illustration and preferred embodiment of the present invention, and it is apparent that numerous alterations, omissions and additions may be made without departing from the spirit thereof.

What is claimed is:

1. A collar stay for removable attachment to a collar or cuff of a garment, comprising:

an elongated member including a slot-like channel formed by a front leg connected at a first end to a bottom leg extending outwardly therefrom, and a back leg connected at a first end to an opposite edge of the bottom leg, the back leg extending essentially parallel to the front leg;

an indent portion formed in the back leg that contacts an inner surface of the front leg; and a plurality of ribs on one end of the elongated member rendering the same flexible for permitting the elongated member to curve to fit a rounded portion of a collar or cuff of a garment;

whereby an edge of the collar or cuff can be inserted into the slot-like channel between inner surfaces of the front leg and back leg, and the collar or cuff is held within the channel by the indent portion.

2. A collar stay of claim 1 and including a plurality of protrusions on an inner surface of the back leg.

3. A collar stay of claim 1 and including an arm extension extending from an upper vertical section of the elongated member.

4. A collar stay of claim 3 wherein the arm extension and the front leg include a plurality of holes.

5. A collar stay of claim 4 and including a cut out in the front leg and back leg permitting a lower section without the arm extension to be folded towards the upper vertical section, the lower section being connected to a lower edge surface of a collar.

6. A collar stay of claim 5 and including a plurality of studs extending from an outer surface of the front leg of the lower section, the studs cooperable with holes in the arm extension to rigidly connect the upper section to the lower section and hold a collar therein.

7. A collar stay of claim 2 in which the protrusions are in the form of arrow-like darts.

8. A collar stay of claim 1 in which the end portions of the front leg and back leg have "U" shaped notches for engaging buttons on a button down type shirt collar.

9. A collar stay of claim 1 in which the indented back leg has a flared opening for easy insertion of the edge portion of a material.

10. A collar stay of claim 4 in which the front leg of the upper vertical section is of various design configurations, like that of filigree and with holes at suitable locations on the back leg for accepting jewel-like pin fastenings.

* * * * *